US006507774B1

(12) United States Patent
Reifman et al.

(10) Patent No.: US 6,507,774 B1
(45) Date of Patent: Jan. 14, 2003

(54) INTELLIGENT EMISSIONS CONTROLLER FOR SUBSTANCE INJECTION IN THE POST-PRIMARY COMBUSTION ZONE OF FOSSIL-FIRED BOILERS

(75) Inventors: Jaques Reifman, Western Springs, IL (US); Earl E. Feldman, Willowbrook, IL (US); Thomas Y. C. Wei, Downers Grove, IL (US); Roger W. Glickert, Pittsburgh, PA (US)

(73) Assignees: The University of Chicago, Chicago, IL (US); Energy Sustems Associates, Pittsburgh, PA (US)

( * ) Notice: Subject to any disclaimer, the term of this patent is extended or adjusted under 35 U.S.C. 154(b) by 0 days.

(21) Appl. No.: 09/379,401

(22) Filed: Aug. 24, 1999

(51) Int. Cl.[7] ..... G01N 31/00

(52) U.S. Cl. ..... 700/274; 700/32; 700/36; 110/234; 110/345

(58) Field of Search ..... 700/274, 28, 30, 700/32, 33, 34, 36, 48, 49; 110/185, 203, 91, 234, 90, 345; 122/4 A

(56) References Cited

U.S. PATENT DOCUMENTS

| | | | | | |
|---|---|---|---|---|---|
| 5,280,756 | A | * | 1/1994 | Labbe | 110/191 |
| 5,478,542 | A | * | 12/1995 | Chawla et al. | 423/235 |
| 5,570,282 | A | * | 10/1996 | Hansen et al. | 700/41 |
| 5,704,011 | A | * | 12/1997 | Hansen et al. | 706/25 |
| 5,832,842 | A | * | 11/1998 | Frontini et al. | 110/190 |
| 6,048,510 | A | * | 4/2000 | Zauderer | 423/235 |
| 6,243,696 | B1 | * | 6/2001 | Keeler et al. | 706/21 |
| 6,381,504 | B1 | * | 4/2002 | Havener et al. | 700/44 |

OTHER PUBLICATIONS

Baines, "Neural Networks for Boiler Emission Prediction" May 24–26, 1999, IEEE, Instrumentation and Mesurement Technology Conference, vol. 1, pp. 435–439.*

* cited by examiner

*Primary Examiner*—Leo Picard
*Assistant Examiner*—Chad Rapp
(74) *Attorney, Agent, or Firm*—Emrich & Dithmar

(57) ABSTRACT

The control of emissions from fossil-fired boilers wherein an injection of substances above the primary combustion zone employs multi-layer feedforward artificial neural networks for modeling static nonlinear relationships between the distribution of injected substances into the upper region of the furnace and the emissions exiting the furnace. Multi-variable nonlinear constrained optimization algorithms use the mathematical expressions from the artificial neural networks to provide the optimal substance distribution that minimizes emission levels for a given total substance injection rate. Based upon the optimal operating conditions from the optimization algorithms, the incremental substance cost per unit of emissions reduction, and the open-market price per unit of emissions reduction, the intelligent emissions controller allows for the determination of whether it is more cost-effective to achieve additional increments in emission reduction through the injection of additional substance or through the purchase of emission credits on the open market. This is of particular interest to fossil-fired electrical power plant operators. The intelligent emission controller is particularly adapted for determining the economical control of such pollutants as oxides of nitrogen ($NO_x$) and carbon monoxide (CO) emitted by fossil-fired boilers by the selective introduction of multiple inputs of substances (such as natural gas, ammonia, oil, water-oil emulsion, coal-water slurry and/or urea, and combinations of these substances) above the primary combustion zone of fossil-fired boilers.

14 Claims, 4 Drawing Sheets

INTELLIGENT EMISSIONS CONTROLLER FOR SUBSTANCE INJECTION IN THE POST-PRIMARY COMBUSTION ZONE OF FOSSIL-FIRED BOILERS

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

FIELD OF THE INVENTION

This invention relates generally to the reduction of emission levels of one or more pollutants emitted from a fossil-fired combustion process and is particularly directed to a method for optimizing and controlling each of multiple inputs of injected substance (such as natural gas, ammonia, urea, oil, a water-oil emulsion, or a coal-water slurry) above the primary combustion zone of the process for reducing the emission levels of oxides of nitrogen ($NO_x$), carbon monoxide (CO), and other pollutants, and for determining whether it is more cost effective to further reduce emissions with the injection of additional substance or to purchase emission credits on the open market.

BACKGROUND OF THE INVENTION

The introduction of the Clean Air Act Amendments of 1990 delineated environmental. constraints requiring reduction of $NO_x$ emissions from electric utility and industrial boilers. Since 1990, many utilities have implemented expensive physical boiler modifications, such as the conversion to low-$NO_x$ coal burner technology, which achieved 25 to 50% $NO_x$ reductions. Throughout the Eastern United States more stringent regulations will require power plants to reduce $NO_x$ emissions by an average of 55 to 65% from 1990 levels by 2005. Additional physical/operational boiler modifications are being considered to achieve the remaining 5 to 40% reduction. These modifications may include a broader array of technologies, such as the injection of ammonia or urea into the upper region of the furnace and/or natural gas reburning.

Natural gas reburning has been shown to be an effective control technique to significantly reduce the $NO_x$ emissions of coal-fired boilers. In conventional gas reburning, 10 to 20% of the total heat input to the boiler is provided by natural gas injected into the upper region of the furnace above the primary combustion zone. This produces a slightly fuel-rich zone where $NO_x$ is chemically reduced to form atmospheric nitrogen. Overfire air is injected downstream of the reburn zone to provide sufficient air to complete the combustion process and minimize CO emissions. The amount of $NO_x$ reduction from reburning typically increases with the amount of natural gas injected.

Energy Systems Associates (ESA) of Pittsburgh, Pennsylvania and the Gas Research Institute (GRI) of Chicago, Illinois have developed and tested a new, more cost-effective, natural gas reburning process for $NO_x$ control called the Fuel Lean Gas Reburn (FLGR) technology. FLGR relies on the controlled injection of 3 to 7% natural gas heat input into the upper region of the furnace of coal-fired boilers to achieve a 35 to 45% $NO_x$ reduction. Similar to conventional gas reburning systems, FLGR employs natural gas injected above the furnace's primary combustion zone to reduce much of the $NO_x$ to atmospheric nitrogen. However, with FLGR, the natural gas is injected in such a way that the furnace's stoichiometry is optimized on a very localized basis, avoiding the formation of fuel-rich zones and maintaining overall fuel-lean conditions in the furnace. The natural gas is injected at low flue gas temperatures (2000° F. to 2300° F.) using multiple, high-velocity turbulent gas jets that penetrate into the upper furnace areas which have the highest $NO_x$ concentrations. Because the furnace is maintained overall fuel-lean, no downstream overfire completion air is needed to maintain acceptable levels of CO in the stack gas emission. These conceptual and operational differences of the FLGR system result in a more costeffective means of reducing $NO_x$ emissions over the conventional gas reburning technology. The FLGR technology requires lower installed capital costs and lower consumption of natural gas to achieve 35 to 45% $NO_x$ reductions.

The problem of optimizing and controlling the FLGR system as well as the conventional gas reburning technology or other technologies involving the injection of natural gas and/or other substances is complicated because of (a) the dynamic nature of boiler operation where load changes influence furnace flow velocities, flow patterns, gas temperature, and residence time; (b) the nonlinear interactions of many operating variables; and (c) economic considerations involving the free-market pricing and trading of emission credits or allowances, which make it difficult for boiler operating personnel to interpret impacts and consistently adjust the gas injection to maintain optimal, least-cost, control in real time.

The present invention addresses the aforementioned considerations of and problems encountered in the prior art by providing for the more efficient operation of an electric utility or industrial fossil-fired boiler with injected substances (such as natural gas, ammonia, and urea) above the primary combustion zone, including a reduction in the emission of pollutants, using an artificial neural network approach with multivariable nonlinear constrained optimization algorithms for automatically controlling the injection of the substances.

OBJECTS AND SUMMARY OF THE INVENTION

Accordingly, it is an object of the present invention to reduce emissions of one or more pollutants from a fossil-fired combustion process by optimizing and controlling each of multiple inputs of injected substances (such as natural gas, ammonia, oil, water-oil emulsion, coal-water slurry and urea) or combination of such or other substances above the primary combustion zone.

It is another object of the present invention to automatically control the injection rate of various inputs above the primary combustion zone to reduce the emission of pollutants, such as $NO_x$ and CO, for various process operating conditions.

Yet another object of the present invention is to determine for a fossil-fired combustion process with injected substances above the primary combustion zone, whether it is more cost-effective to achieve additional increments in emission reductions through the injection of additional substance or through the purchase of emission credits in the open market based upon considerations of the optimal operating conditions of the substance injection system, the cost of the incremental injected substance, and the open-market price per ton of emission credits.

A still further object of the present invention is to determine optimal operating conditions for the injected substances using nonlinear constrained optimization methods and artificial neural networks for modeling the nonlinear relationships between the emissions exiting the furnace and the distribution of the injected substances into an upper region of the furnace.

This invention operates to control emissions from fossil-fired boilers through the optimization of the distribution of injected substances above the primary boiler combustion zone. The invention employs artificial neural networks for modeling the nonlinear relationships between the emissions exiting the furnace and the distribution of substances injected into an upper region of the furnace. The mathematical expressions derived from the artificial neural networks are used to solve this multivariable nonlinear constrained optimization problem that provides the optimal substance distribution that minimizes emission levels for a given substance consumption rate. The invention further contemplates an advisory operations support system which determines whether it is more cost-effective to achieve additional increments in emission reductions through the consumption of additional substance (e.g., natural gas, ammonia, oil, water-oil emulsion, coal-water slurry and/or urea) or through the direct purchase of emission credits in the open market based upon the optimal operating conditions determined from the aforementioned multivariable optimization, the cost of incremental injected substance, and the open-market price per ton of emission credits.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF PREFERRED EMBODIMENT

Plant data from demonstration tests conducted at the Commonwealth Edison Joliet Station 9 Unit 6 (JSU-6) coal-fired electric power plant in Joliet, Illinois during the summer of 1997 were used in developing this invention. JSU-6 is a 320 MWe cyclone design boiler that is fueled with low-sulfur Western Powder River Basin subbituminous coal. The boiler consists of a single furnace divided into superheat and reheat regions. The unit is fired with nine horizontal cyclones; four cyclones are located along the north wall of the furnace and five are located along the south wall. The boiler is capable of delivering a maximum of 2.2 million pounds of steam per hour at 2000 psi, 1015° F. on the superheat side, and 1005° F. on the reheat side.

Figure 1:
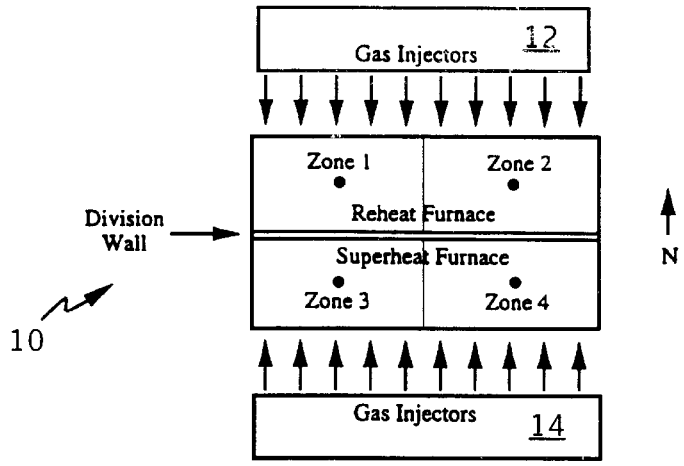
FIG. 1 is a simplified schematic diagram of the clustering of injected natural gas into four zones in the upper region of a furnace above the primary combustion zone of a coal-fired boiler for reducing emissions.

The FLGR system installed at JSU-6 consists of a total of 36 natural gas injectors divided equally between the north wall of the reheat side of the furnace and the south wall of the superheat side of the furnace. The four zones of the furnace 10 are shown in the simplified schematic diagram of FIG. 1, as is the clustering of the injected gas into the four zones. The gas injectors 12 and 14 are located at two different furnace elevations and are designed so that a maximum of 26 injectors can operate simultaneously. Twenty-six gas injectors are located at 208 feet, which is approximately 56 feet below the entrance of the convective section of the boiler, and the remaining 10 injectors are located 21 feet higher at 229 feet. The gas system was designed to supply a maximum of 12% gas heat input with the unit at full load and the maximum gas flow rate per individual injector ranged from about 6 to $24\times10^6$ Btu per hour, or equivalently 6 to 24 kscfh. The gas jets were designed to operate at sonic conditions at 35 psig of gas pressure. The system also makes use of extraction steam as a gas carrier to improve the gas jet penetration. Steam is supplied to each injector at a one-to-one mass ratio with natural gas.

Twenty probes for measuring $NO_x$ and CO emissions, as well as excess oxygen ($O_2$) in the flue gas, are also installed at JSU-6. All 20 probes are located at one elevation downstream of the gas injection and beyond the economizer outlet. The probes are uniformly distributed throughout the cross-sectional area of the furnace with 10 probes in the reheat side of the furnace and 10 probes in the superheat side. Since it takes approximately one hour to collect measurements from the 20 probes and the time response of the furnace to changes in the gas injection is on the order of a few minutes, the $NO_x$, CO, and $O_2$ probe measurements were taken during steady-state operation of the plant and the injectors.

Approximately 80 steady-state parametric optimization tests of the FLGR system (including baseline tests without injected gas) were conducted at JSU-6 over an eight-week period. The purpose of these tests was to establish the effect of the spatial distribution of natural gas on $NO_x$ and CO formation and to manually obtain the gas distribution required to achieve the maximum $NO_x$ reduction while maintaining CO emissions below 200 parts per million (ppm). The tests were conducted over a range of boiler loads and operating conditions with heat input from natural gas ranging from approximately 3 to 8% of the total fuel heat input to the plant. The injected gas distribution was also varied in the tests. Different distributions between the superheat side of the furnace and the reheat side as well as different distributions within each of the two sides were used. In addition, gas was injected with and without the inclusion of steam.

Using the available data, a database consisting of the entire set of parametric tests performed was constructed. The database documents the spatial flow rates of natural gas to the boiler and the corresponding spatial distribution of the concentrations of $NO_x$, CO, and $O_2$ exiting the furnace beyond the economizer outlet. In addition, the database contains important boiler operating data such as boiler load. The available data were then analyzed to determine key process interactions necessary to develop a framework for the neural network modeling.

Analyses of the test results indicate a 35 to 40% average $NO_x$ reduction for boiler loads ranging from. 200 MWe to 320 MWe (full load) using 7% natural gas heat input, with slightly greater $NO_x$ reductions being achieved at reduced (<320 MWe) boiler load. $NO_x$ reduction at full load seems to be insensitive to the elevation of the gas injection, but the optimum gas distribution profile is load dependent and is influenced by operational fluctuations of the unit. Also, the use of extraction steam as a gas carrier did not seem to provide any significant improvement in $NO_x$ reductions. The parametric tests show that the limiting factor to greater $NO_x$ reduction, and often for sustained reductions at 40%, is the formation of excessive levels of CO (>200 ppm). CO formation tended to be very non-uniform throughout the furnace and somewhat erratic, and high CO levels often correlated with low $O_2$ levels, suggesting that decreasing the input of natural gas in regions with high CO would raise the excess oxygen and decrease the CO.

The percentage of $NO_x$ reduction is not necessarily linearly correlated to the amount of natural gas heat input. Under certain conditions, increasing the amount of natural gas heat input results in little to no further improvement in the amount of $NO_x$ reduction. Since the general direction of future $NO_x$ control strategies will be based on a least-cost approach involving the free-market pricing and trading of emission allowances, and since on a heat-equivalent basis gas is more expensive than coal, a user of the FLGR system should only increase the gas heat input when it is cost-effective with respect to the value of the emissions abated. Therefore, plant operators need to know when each increment of natural gas heat input is cost-effective with respect to the additional $NO_x$ reduction achieved.

Due to the limited amount of data collected for each load level in the parametric tests of the FLGR system at JSU-6, the dependency of emissions formation on boiler load, and the erratic behavior of CO, modeling was restricted to $NO_x$ emissions at full boiler load. Moreover, to reduce the number of inputs and outputs of the model, the multi-point spatial distribution of injected natural gas was lumped into four zones and the 20 probe measurements of $NO_x$ emissions were averaged to yield a representative steady-state $NO_x$ level at the furnace exit. The aggregate amount of gas injected in the west-half of the reheat side of the furnace was represented in the model by the flow rate in zone 1, $g_1$, and the aggregate amount of gas injected in the east-half of the reheat side of the furnace was represented in the model by the flow rate in zone 2, $g_2$. Similarly, the gas injected in the superheat side of the furnace was represented by the flow rates in zones 3 and 4, $g_3$ and $g_4$. The gas flow rates in these four zones served as the four inputs to the neural network model and were used to predict the boiler average steady-state $NO_x$ emissions levels, the output of the model. Hence, the neural network model used here has four units in the input layer and one unit in the output layer and relates the natural gas flow rate in each of the four zones $g_j$ (j=1,2,3,4) to an average steady-state $NO_x$ level exiting the furnace, $$NO_x = f(g_1, g_2, g_3, g_4, w), \tag{1}$$

where the vector w denotes the weights, or the adjustable parameters, of the neural network model.

A $NO_x$ emissions model was developed for full-load boiler operating conditions with heat input from natural gas ranging from approximately 6 to 8% of the total fuel heat input to the plant. For the JSU-6 at 320 MWe, 6% of natural gas heat input corresponds to a flow rate of about 177 kscfh and 8% corresponds to 236 kscfh. The model development was based on the 20 test results tabulated in Table 1. These were basically the only tests, of the 80 parametric tests of the FLGR system performed at the JSU-6, that were performed at full boiler load with injected gas ranging from 6 to 8% of heat input. As can be determined from Table 1, the majority of these tests, however, were performed with about 7% or 206 kscfh of heat input from natural gas.

A three-layer feedforward neural network architecture was used for developing the model with training performed using the conjugate gradient version of the backpropagation algorithm. The network units in the input layer are mapped by a linear function and the units in the hidden layer and the output layer are mapped by a sigmoid function. The sigmoid function mapping the output $x_n^{(l)}$ of the n'th unit in the l'th layer, with l>1, is given by $$x_n^{(l)} = \frac{1}{1 + e^{-net_n^{(l)}}}. \tag{2}$$

Here $net_n^{(l)}$ denotes a linear weighted sum over the $J_{i-1}$ units of the outputs $x_m^{(l-1)}$ (m=1,2, . . . ,$J_{l-1}$) of the immediately preceding layer plus a threshold $\theta_n^{(l)}$ of the n'th unit in the l'th layer:

$$net_n^{(l)} = \sum_{m=1}^{J_{l-1}} w_{nm}^{(l)} x_m^{(l-1)} + \theta_n^{(l)}, \tag{3}$$

where $w_{nm}^{(l)}$ is the weight connecting the output of the m-th unit in the (l−1)'th layer to the n'th unit in the l'th layer.

Many different emission models were developed by varying (1) the initial weights at the onset of the network training, (2) the number of nodes in the hidden layer, and (3) the subset of experiments used for training purposes. Since the conjugate gradient method dynamically optimizes the learning parameter and the momentum parameter, these did not enter as study parameters. The neural network model which was selected for use with the controller was trained (or developed) with input/output data pairs from 15 of the 20 tests in Table 1. This neural network model produced the smallest overall differences between the predicted and the measured values of $NO_x$ for the remaining five tests (5, 10, 15, 17, and 20) which were reserved for validation purposes and were not used for training. For developing the neural network model, the gas flows were normalized between 0 and 1 with 0 corresponding to the smallest flow rate, $g_{min}$=34.90 kscfh, observed in any one of the four zones in the 20 tests and 1 corresponding to the largest flow rate, $g_{max}$=72.13 kscfh, in any one zone. Similarly, $NO_x$ was normalized between 0.2 and 0.8 corresponding to 0.47 Ibm/MBtu and 0.68 Ibm/MBtu, respectively. The choice of 0.2 instead of 0 and of 0.8 instead of 1 was made to avoid the slow training process at the saturation regions of the sigmoid function.

Figure 2:
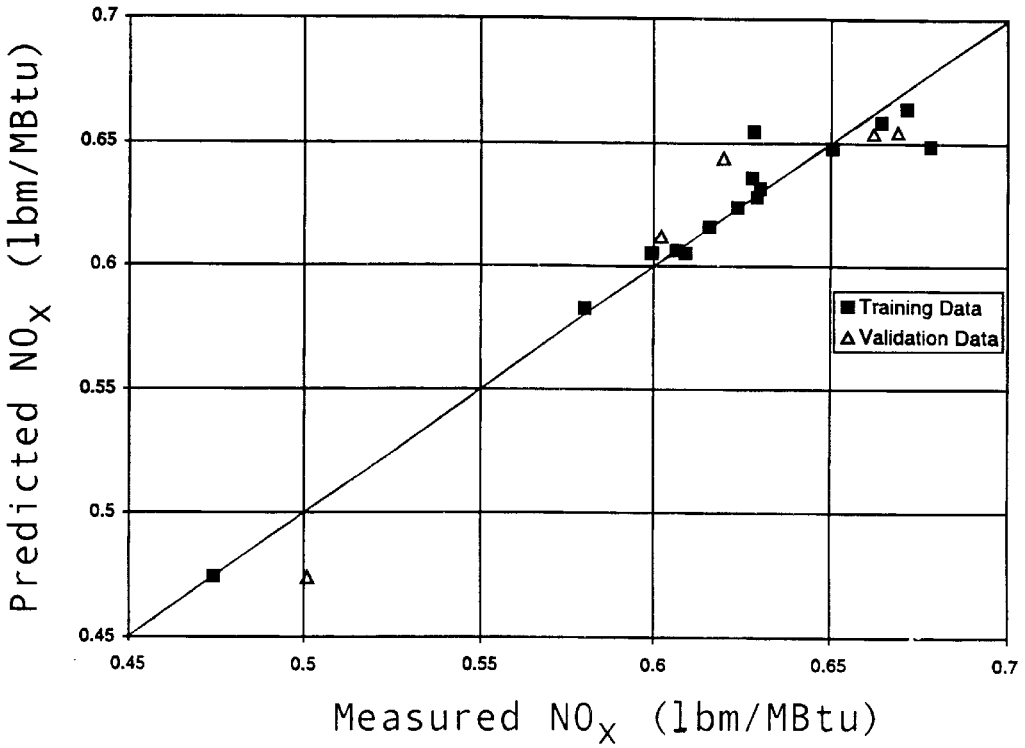
FIG. 2 is a graphic representation of the measured $NO_x$ versus predicted $NO_x$ using neural networks in accordance with the present invention.

FIG. 2 shows the values of measured versus predicted $NO_x$ for the 15 experiments used for training the model and the 5 experiments used for validating the model. In spite of the limited amount of available data, the model was able to predict $NO_x$ emission levels as a function of the distribution of injected gas in the four zones within 6% of the measured values. The achieved accuracy is quite adequate since it falls within measurement uncertainties. $NO_x$ emission measurements differed by about 6.5% in repetitive experiments, such as in tests 5 and 6 and tests 9 and 10, where the same gas flow was injected in each of the 36 injection points.

Figure 3:
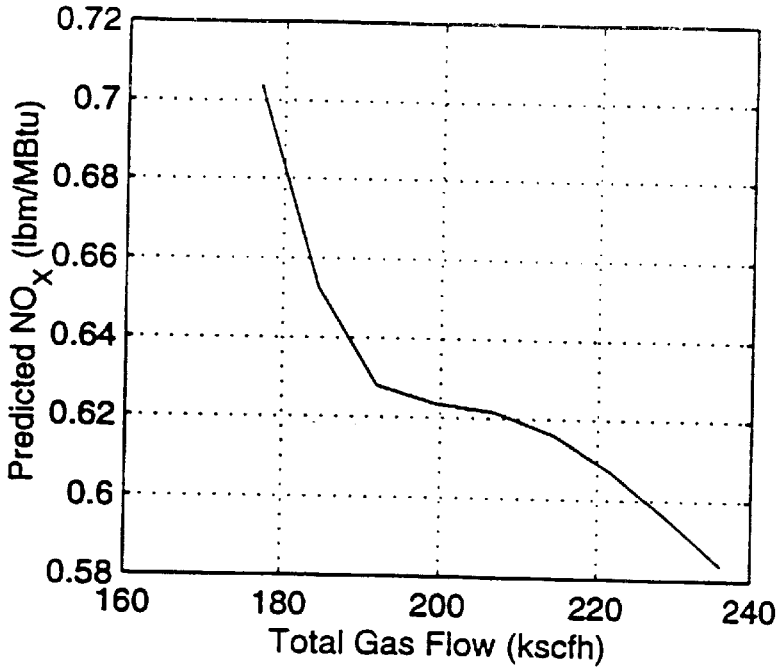
FIG. 3 is a graphic representation of the $NO_x$ response to changes in total gas flow for uniform gas distribution in the four zones of the furnace shown in FIG. 1.
Figure 4:
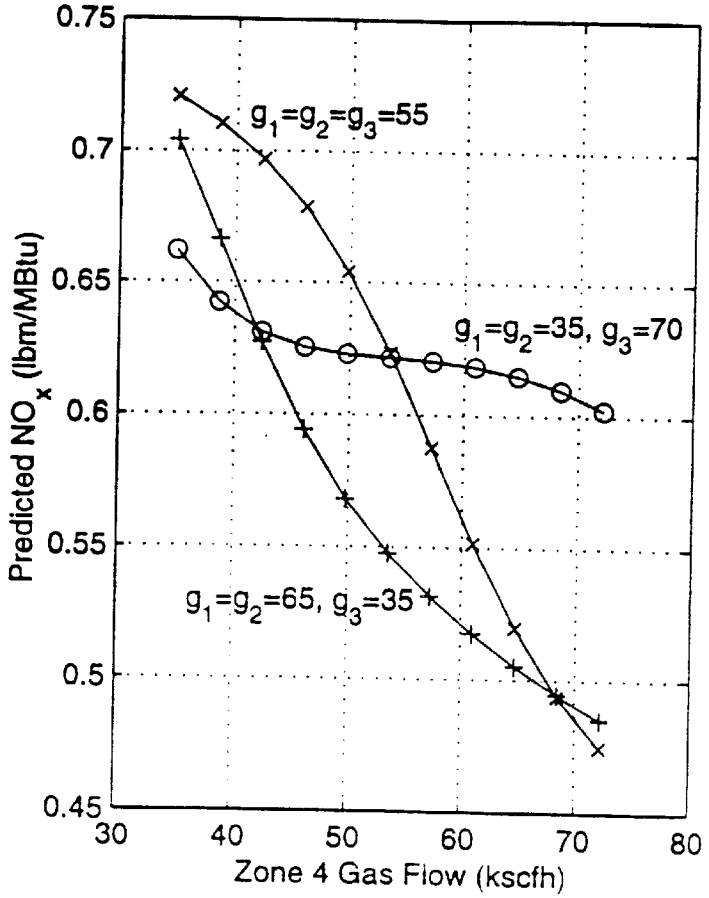
FIG. 4 is a graphic representation of the $NO_x$ response to changes in the gas flow in zone four of the furnace shown in FIG. 1 while holding the gas flows constant in the other three zones.

Sensitivity analysis of the model was also performed through various simulation tests. For instance, in a test designed to establish the dependency of $NO_x$ on the overall natural gas input into the furnace, the neural network predicted $NO_x$ values were evaluated for changes in the total gas flow between 6% (177 kscfh) and 8% (236 kscfh) for a uniform gas distribution among the four zones. As indicated in FIG. 3, $NO_x$ decreases monotonically but not linearly as the amount of natural gas is increased uniformly in the four zones. While the qualitative behavior of the model for this simulation test confirms our expectations, its quantitative estimates are probably not very accurate due to the limited amount of available data for training the model. In other simulation tests, however, we were uncertain about the qualitative behavior of the model. For example, in a simulation test where the gas flow rate in one of the four zones was varied from the minimum to the maximum value, i.e., from 34.90 to 72.13 kscfh, and the gas flow in the other three zones was held constant at predefined levels, the $NO_x$ response was highly dependent on the three fixed gas flow rates and varied significantly with changes in them. In some cases, the $NO_x$ behavior was flat. In other cases, $NO_x$ increased monotonically, decreased monotonically, or varied non-monotonically. FIG. 4 illustrates the results of three simulation tests obtained when the gas flow in zone 4 was varied and the gas flow in the other three zones was held fixed at different sets of constant values. Each curve corresponds to one simulation, e.g., the curve with the smallest gradient was obtained by varying $g_4$ while holding $g_1$ and $g_2$ at 35 kscfh and $g_3$ at 70 kscfh. For zone 4, the model indicated that the $NO_x$ emission levels depend on the gas distribution of the other three zones, but in all cases $NO_x$ decreases monotonically with increasing gas flow. Similar model behavior was not observed in the other zones.

With the emissions model in place, we then pursued the development of the FLGR system controller. The approach is to use the neural network emissions model to develop and fine tune an optimal controller which can subsequently be integrated with the actual plant. This controller, described in detail below, determines the optimal gas distribution among the four zones that results in the largest $NO_x$ reduction for a given amount of total injected gas.

Given the static neural network emissions model relating the natural gas flow rate in each of the four zones $g_j$ (j=1,2,3,4) to the average $NO_x$ level exiting the furnace, optimization of the FLGR system for steady state operation can be cast as a mathematical programming problem. For example, we might want to find the steady state gas distribution that minimizes $NO_x$ subject to a given total gas consumption rate G and range of values for $g_j$. Mathematically, this optimization problem can be expressed as a minimization of the objective function in Eq. (1)

$$\underset{g_j}{\text{minimize}}\ NO_x = f(g_1, g_2, g_3, g_4) \tag{4}$$

subject to

-continued $$G = \sum_{j=1}^{4} g_j, \text{ and}$$

$$g_{\min} \le g_j \le g_{\max}, \text{ for all } j = 1 \text{ to } 4$$

where $g_{min}$=34.90 kscfh and $g_{max}$=72.13 kscfh correspond to the minimum and maximum, respectively, gas flow rate allowed in each zone. As $NO_x$ is a nonlinear function of $g_j$, this is a nonlinear programming problem with equality and inequality constraints in the control variables which can be solved by any number of well-established nonlinear constrained optimization techniques.

Here, we propose a new approach based on multilayer feedforward neural networks for solving this multivariable nonlinear constrained optimization problem with equality and inequality constraints. Although the description below is geared to this specific problem, the approach applies to a large class of optimization problems including problems with nonlinear constraints and inequality constraints other than the bounding or box constraints that appear in this problem. The function f to be minimized does not need to be represented by a neural network model. The function f only needs to have continuous first derivatives—a universal requirement for optimization algorithms based on gradient calculations—that can be numerically evaluated. The same requirements apply to the constraint functions; they need to be continuously differentiable. No other requirements or assumptions on the functions appearing in the problem, such as convexity, are needed to apply the method.

In the inventive neural network formulation, the solution of an N-dimensional constrained optimization problem is obtained by solving a sequence of M-dimensional (with M>N) unconstrained optimization problems with a modified objective function where M represents the number of weights or adjustable parameters of the neural network. Each solution of the unconstrained problem is a feasible or candidate solution of the original problem, that is, it satisfies the original problem constraints, and is used in an iterative search for the optimal solution. Constrained optimization problems are transformed into unconstrained ones by incorporating the constraint functions in a "modified" objective function of the original problem. Such a practice is widely used in mathematical programming algorithms, as is the case for methods using penalty functions where the objective function is augmented by the penalty functions associated with the constraints. In our indirect approach of handling constraints, for each equality constraint and for each inequality constraint (except for bounding inequality constraints on individual variables) there is a corresponding term in the objective function.

The solution of the nonlinear constrained optimization problem in Eq. (4) is obtained through a sequence of training sessions of the neural network controller/model system representation illustrated in FIG. 5. Each training session confirms if a given setpoint value for $NO_x$, $NO_x^{SP}$, is a feasible solution to the original problem, and if so, the training session provides the corresponding gas distribution $g_j$. For a given $NO_x^{SP}$ and the total gas flow rate G, the controller/model system is trained by finding the weights w of the multilayer feedforward neural network representing the controller so that the objective function $$E = E(w) = E_1 + E_2 = \frac{1}{2}(NO_x^{SP} - NO_x)^2 + \frac{1}{2}\left(G - \sum_{j=1}^{4} g_j\right)^2 \quad (5)$$

is minimized. The first term of the "modified" objective function E assures that the control laws provided by the controller yield the desired $NO_x$ setpoint and the second term accounts for the equality constraint. The objective function E is therefore formed by the sum of the squares of the deviations of given values ($NO_x^{SP}$ and G) from predicted values ($NO_x$ and $g_j$), which is very similar to the objective function used in least squares fitting. Appropriate normalization of the controller outputs directly accounts for the inequality bounding constraints on each of the four gas flow rates $g_j$.

Figure 5:
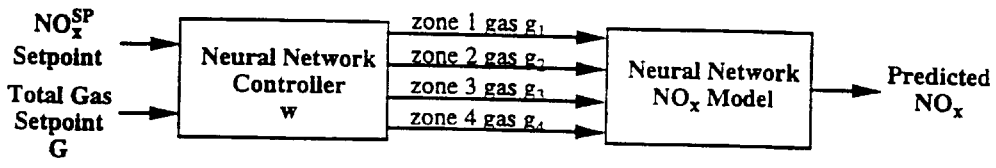
FIG. 5 is a simplified schematic diagram of a neural network controller/emissions model system used as an illustration of the present invention.
Figure 6:
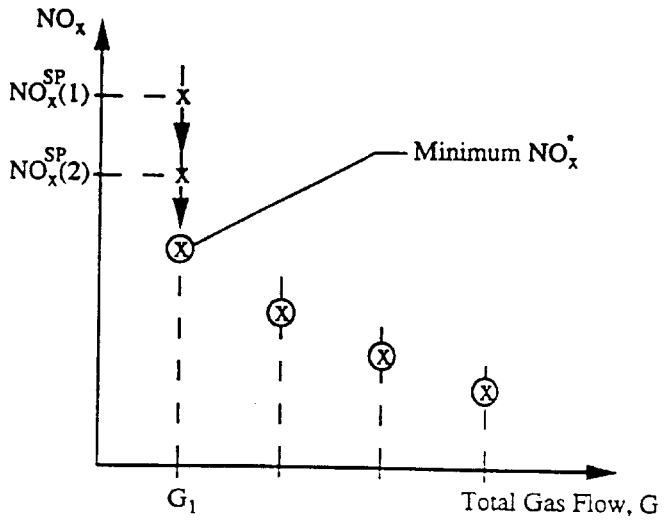
FIG. 6 is a simplified schematic diagram of an iterative procedure for establishing the optimal operating conditions for the Fuel Lean Gas Reburn system in accordance with the present invention.

For a fixed total gas flow G, say, $G_1$, the optimum $NO_x$, $NO_x$*, and the corresponding optimal gas distribution $g_j$ (j=1,2,3,4) are obtained through a sequence of training sessions of the controller/model system representation in FIG. 5. We start this iterative approach by selecting a large value for $NO_x^{SP}$, say, $NO_x^{SP}$(1), and providing the same two inputs, $NO_x^{SP}$(1) and $G_1$, repeatedly to the controller/model system during the first training session of the sequence. If the training is successful, i.e., if weights w can be found that minimize Eq. (5), then $NO_x^{SP}$(1) is a feasible solution to the original problem and the controller outputs provide the corresponding gas distribution $g_j$. Next, we select another value for $NO_x^{SP}$, say, $NO_x^{SP}$(2), with $NO_x^{SP}$(2)<$NO_x^{SP}$ (1), and perform a second training session. If the training is successful, then $NO_x^{SP}$(2) is another feasible solution of the original problem. Otherwise, a value of $NO_x^{SP}$ between $NO_x^{SP}$(1) and $NO_x^{SP}$(2) is selected. By repeating such a procedure for additional values of $NO_x^{SP}$ we can find the smallest $NO_x$ for which the training converges.[13] This smallest $NO_x$ is the desired optimal $NO_x$, $NO_x$*, for a given total gas flow $G_1$. This can then be confirmed by showing that the estimated optimal solution satisfies the Karush-Kuhn-Tucker (KKT) necessary conditions for local optimality of nonlinear constrained functions to within a certain tolerance.[12] By repeating such a procedure for different values of G, we can then obtain the optimal operating conditions of the FLGR system throughout the range of allowable total gas flow rates. FIG. 6 provides a graphical illustration of such an approach.

Training the controller/model system in FIG. 5 consists of solving an unconstrained nonlinear minimization problem, in the generally large, M-dimensional weight-space w of the multilayer feedforward neural network controller. The difficulty in solving this optimization problem in a larger dimensional space in comparison with the N-dimensional control-space (N=4 for this problem) is more than offset by the simplicity of solving an unconstrained optimization problem as opposed to a constrained one. The unconstrained minimization of E(w) in Eq. (5) is solved interactively based on calculations of the gradient $\nabla E(w)$ through the method of conjugate gradients. The components of $\nabla E(w_k)$ are computed recursively, for iteration k, by starting at the units in the output layer of the neural controller and working backward to the units in the input layer. To simplify the notation in the discussions to follow we suppress the iteration subscript k and the pattern subscript p corresponding to the inputs $NO_x^{SP}$ and G. A component of $\nabla E(w)$ corresponding to the weight $w_{ji}^{(l)}$ connecting the i'th unit in the (l−1)'th layer to the j'th unit in the l'th layer is given by $$\frac{\partial E}{\partial w_{ji}^{(l)}} = -[\delta_{1j}^{(l)} + \delta_{2j}^{(l)}]x_i^{(l-1)}. \quad (6)$$

If the l'th layer is the output layer, i.e., l=L, then $$\delta_{1j}^{(L)} = (NO_x^{SP} - NO_x)x_j^{(L)}(1 - x_j^{(L)})\frac{\partial NO_x}{\partial x_j^{(L)}}, \text{ and} \quad (7)$$

$$\delta_{2j}^{(L)} = \left(G^{SP} - \sum_{j=1}^{J_L} x_j^{(L)}\right)x_j^{(L)}(1 - x_j^{(L)}),$$

where $J_L$=4, $x_j^{(L)}$=$g_j$ (j=1,2,3,4), and $\partial NO_{x/\partial xj}^{(L)}$, derived in the Appendix, is computed by noting that the outputs of the neural controller $x_j^{(L)}$ are the inputs of the neural network emissions model. For any unit in a subsequent hidden layer, i.e., 1</<L, $$\delta_{1j}^{(l)} = x_j^{(l)}(1 - x_j^{(l)})\sum_{m=1}^{J_{l+1}} \delta_{1m}^{(l+1)} w_{mj}^{(l+1)}, \text{ and} \quad (8)$$

$$\delta_{2j}^{(l)} = x_j^{(l)}(1 - x_j^{(l)})\sum_{m=1}^{J_{l+1}} \delta_{2m}^{(l+1)} w_{mj}^{(l+1)}.$$

This algorithm is very similar to the backpropagation algorithm used to compute $\partial E/\partial w_{ji}^{(l)}$ for stand-alone feedforward multilayer neural networks.[2] The major differences are the presence of two δs, as opposed to only one δ, corresponding to the two components of E, $E_1$, and $E_2$, in Eq. (5) and the extra term $\partial NO_x/\partial x_j^{(L)}$ in $\delta_{1j}^{(L)}$ in Eq. (7) corresponding to the derivative of the emissions model output with respect to its inputs.

In summary, we invented a new method for solving multi-dimensional constrained nonlinear optimization problems through feedforward neural networks. The approach is to transform a constrained optimization problem in the N-dimensional control-space into a sequence of unconstrained optimization problems in the larger M-dimensional weight-space of a multilayer feedforward neural network. The constraints of the original problem are handled indirectly through the transformation of the original objective function into a modified objective function which incorporates each equality constraint and each inequality constraint (except for bounding inequality constraints on individual variables) into an additional term of the objective function. The sequence of unconstrained optimization problems is solved by training the neural network controller in the combined controller/model system architecture for a sequence of different inputs. The training is based on gradient calculations of the modified objective function with respect to the neural network controller weights through the method of conjugate gradients. Each solution of the sequence, i.e., each input/output of the neural network, is a feasible solution of the constrained problem and the last solution of the sequence corresponds to the sought optimal solution.

The inventive neural-network-based optimization algorithm was then applied to solve the mathematical programming problem of Eq. (4). That is, the algorithm was applied to find the steady state gas distribution in the four zones $g_j$ that minimizes $NO_x$ subject to a given total gas consumption rate G and range of allowable values for $g_j$. Following the controller/model representation depicted in FIG. 5, a 2-6-4 architecture was selected for the feedforward neural network representing the controller. The two units in the input layer correspond to $NO_x^{SP}$ and total gas G, and the four units in the output layer correspond to the gas flow rates $g_j$ in the four zones. The one hidden layer with six units was arbitrarily selected. This neural network architecture contains a total of 46 weights, i.e., M=46, which were obtained by minimizing the unconstrained objective function E in Eq. (5) through the method of conjugate gradients based on the gradient calculations of Eq. (6).

Figure 7:
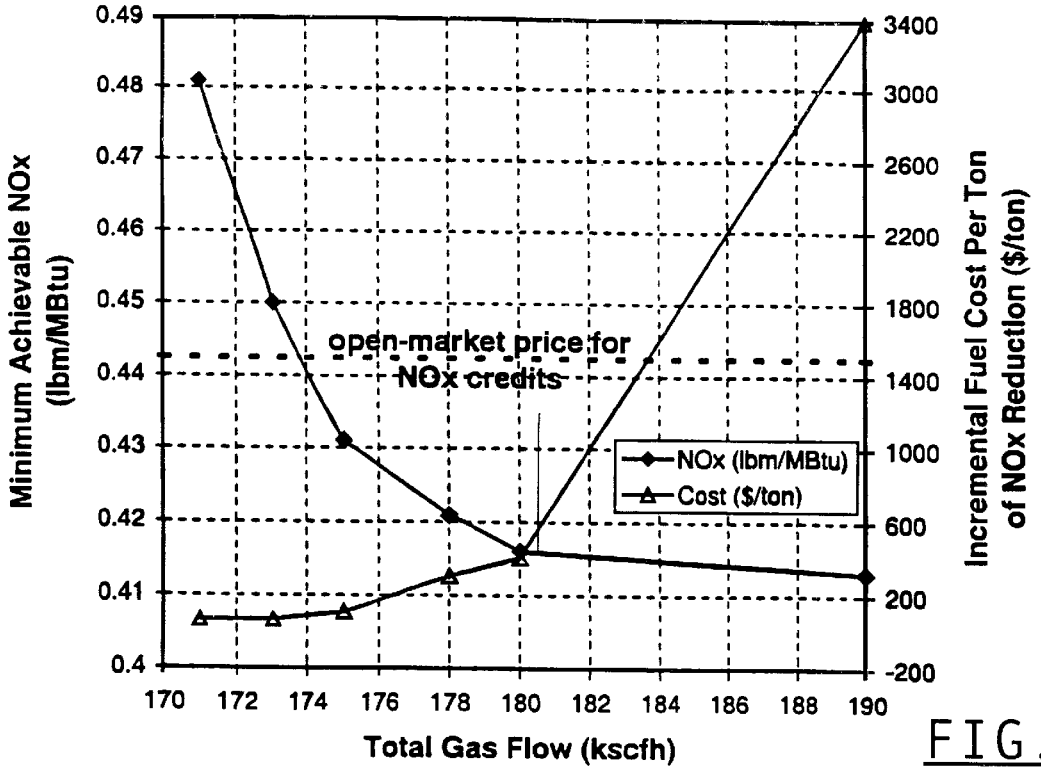
FIG. 7 shows the optimal operating curve (the minimum achievable $NO_x$ levels as a function of total gas flow) obtained with the neural network-based optimization method of the present invention and the incremental fuel cost per ton of $NO_x$ reduction.

FIG. 7 shows the optimal operating curve (the minimum achievable $NO_x$ levels as a function of total gas flow) obtained with the neural-network-based optimization method. This entire curve is outside of the region—total gas≧176.5 kscfh and $NO_x$≧0.47 Ibm/MBtu—where all of the points used for training (developing) the $NO_x$ emissions model are located. This is not surprising because during the data collection the optimal gas distribution for each value of total gas was not known. The degree of the emissions model extrapolation beyond the training region is moderate, however, in that the optimal curve is not more than 3% below 176.5 kscfh and 14% below 0.47 Ibm/MBtu.

Figure 8:
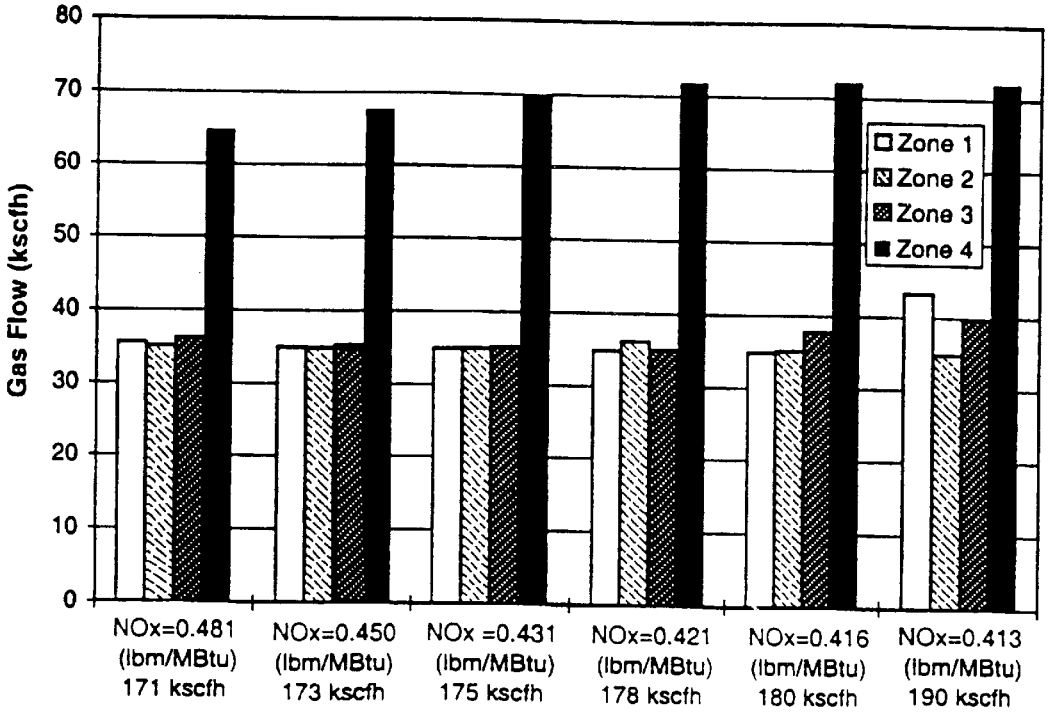
FIG. 8 graphically shows the optimal gas flow distribution for the four injection zones of the furnace shown in FIG. 1 for various values of total gas flow.

The controller was used to find minimum values of $NO_x$ levels for six values of total gas, 171, 173, 175, 178, 180, and 190 kscfh. The obtained results are consistent with our expectations; minimum achievable $NO_x$, $NO_x$*, decreases monotonically with increasing total gas flow. The corresponding optimal gas flow distribution in the four zones, $g_j$*, for each one of the six values of total gas flow is illustrated in FIG. 8. The optimal control strategy thus obtained is to keep the gas flow in zones 1–3 near the lower bound limit of 34.90 kscfh and increase the flow in zone 4 to meet the constraint on the total gas flow. Once the upper bound limit of 72.12 kscfh is reached in zone 4, the optimal solutions for total gas flow larger than 176.82 kscfh (3×34.90+72.12) primarily are achieved by increasing the gas flows in zones 1 and 3 to satisfy the total gas flow constraint. These optimal solutions are consistent with the strategy of adding gas to the zone which provides the largest $NO_x$ reduction per unit increase in gas. Zone 4 (depicted in FIG. 4) has the largest unit $NO_x$ reduction over the range of gas values for this problem, making it the preferred control variable.

The optimal gas flow distribution obtained in accordance with the present invention was first confirmed by showing that the computed $g_j$* for each one of the six values of total gas satisfy the KKT conditions for optimality. Further validation was performed by solving the same constrained optimization problem with an off-the-shelf optimization tool that uses a version of the well-known Generalized Reduced Gradient method. For the six optimization problems, the maximum deviation between the proposed method and the off-the-shelf tool for the optimal $NO_x$ was 0.73% (with the tool estimating the smaller value) and the maximum deviation for the four control variables was 3.6%. Tightening of the neural network convergence criteria would decrease the small discrepancies in the results.

In addition to leading to consistently improved average $NO_x$ reductions and lower average rates of natural gas consumption, the results of the optimal controller would also allow plant personnel to make decisions regarding the best operation of the FLGR system based on economic considerations utilizing a least-cost approach involving the free-market pricing and trading of emission allowances. For instance, based on the minimum achievable $NO_x$ results discussed above and assuming that the fuel price differential between natural gas and coal is $1.50/Mbtu, the cost can be calculated, as shown in FIG. 7, in dollars per ton for each additional increment of $NO_x$ reduction achieved with the FLGR system. Based on the optimal operating conditions, at 180 kscfh each additional increment of $NO_x$ reduction costs $400 per ton, at 183.50 kscfh the additional cost matches the open-market price of $1500 per ton, and at 190 kscfh the additional cost is $3400 per ton. Hence, the theoretical most economic operating point is at 183.50 kscfh, independent of the $NO_x$ requirement for the plant. If the plant $NO_x$ emission levels are below the allowed environmental maximum, the excess reduction can be sold on the open-market at a profit and if they are above, the deficit can be purchased from the open-market for less than the cost of the additional gas.

Even if the FLGR system in practice cannot be operated at the theoretical optimum due to measurement and other uncertainties, but only in some neighborhood of the optimal operating point, the AI-based controller would still produce substantial savings and $NO_x$ reductions. For example, if the controller can reduce the average $NO_x$ emission rate by just 0.02 Ibm/MBtu (<5% of the baseline value) on a 200 MWe average boiler load, then the total $NO_x$ tonnage reduction during a typical May through September ozone season will be about 60 tons of $NO_x$. Assuming that $NO_x$ allowances have a value based on current estimates at $1500 to $2000 per ton during the ozone season, the annual savings of using the Al controller would be about $90,000 to $120,000 for a single unit.

There has thus been shown an approach for investigating artificial neural network techniques for controlling the spatial distribution and total rate of injection of natural gas of a Fuel Lean Gas Reburn system for $NO_x$ control in coal-fired boilers. Multilayer feedforward artificial neural networks are applied in developing a static model of the process representing the nonlinear relationships between the distribution of the injected natural gas into the upper region of the furnace and the average $NO_x$ exiting the furnace. The neural network process model is then used to develop a neural network controller that provides the optimal control solutions for steady state plant operating conditions. Plant data from a full-scale demonstration of the FLGR system conducted at one of Commonwealth Edison's cyclone-type coal-fired electric power plants were used in developing the present invention. The invention development was based on gas flow rates and $NO_x$ emissions data from 20 parametric tests performed at 100% of nominal power and total injected gas ranging from 6 to 8% of heat input. In spite of the limited amount of available data, the model was able to predict $NO_x$ emission levels for injected gas data not used in developing the model within measurement uncertainties.

The established neural network $NO_x$ model is integrated with a neural network controller to provide optimal control of the FLGR system for steady state operating conditions. This controller provides the optimal distribution of the injected natural gas that yields the largest $NO_x$ reductions for a given rate of total gas consumption. Very good agreement was obtained by comparing the neural controller results against optimization results obtained with an off-the-shelf mathematical programming routine. In addition to providing the gas distribution that results in the minimum achievable $NO_x$ emission levels for a given rate of natural gas heat input, these results permit the use of a least-cost approach for $NO_x$ control involving the free-market pricing and trading of emission credits. Additional expenditure associated with each increment of natural gas heat input is considered only when it is cost-effective based on the value of the emissions abated.

The neural network controller consists of a new methodology for solving multivariable nonlinear constrained optimization problems. The approach is to transform an original constrained optimization problem in the N-dimensional control space into a sequence of unconstrained optimization problems in the larger M-dimensional weight-space of a multilayer feedforward neural network. The difficulty in solving an optimization problem in the larger M-dimensional weight space is more than offset by the simplicity of solving an unconstrained optimization problem, as opposed to a constrained one, in the smaller N-dimensional control space. The constraints of the original problem are handled indirectly through the transformation of the original objective function into a modified objective function which incorporates each equality constraint and each inequality constraint into an additional term of the objective function. Bounding inequality constraints are directly accounted for through the appropriate normalization of the neural network outputs. The sequence of unconstrained optimization problems is solved by training the neural network controller in the combined controller/model system architecture for a sequence of different inputs where each solution of the sequence is a feasible solution of the original constrained problem and the last solution of the sequence corresponds to the sought optimal solution. Training of the controller is accomplished with the method of conjugate gradients based on gradient calculations of the modified objective function with respect to the neural network controller weights. In addition to its simplicity, another advantage of the approach relates to the very mild restrictions on the functions appearing in the mathematical programming problem. The original objective function and the constrained functions only need to have continuous first derivatives, and no other requirements, such as convexity, are needed to apply the method.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

TABLE 1

Test data used for training and validation of the neural network $NO_x$ emissions model

| | Gas Flow Rate (kscfh) | | | | | $NO_x$ |
|---|---|---|---|---|---|---|
| Test No. | Zone 1 | Zone 2 | Zone 3 | Zone 4 | Total | (lbm/MBtu) |
| 1 | 46.52 | 36.06 | 51.26 | 46.91 | 180.8 | 0.58 |
| 2 | 39.5 | 40.4 | 49.05 | 49.05 | 178 | 0.63 |
| 3 | 35.86 | 36.88 | 66.03 | 65.71 | 204.5 | 0.61 |
| 4 | 39.57 | 41.03 | 47.87 | 48.03 | 176.5 | 0.67 |
| 5 | 62.16 | 45.05 | 43.01 | 59.35 | 209.6 | 0.5 |
| 6 | 62.17 | 45.06 | 43.01 | 59.35 | 209.6 | 0.47 |
| 7 | 40.75 | 41.75 | 50.8 | 50.8 | 184.1 | 0.61 |
| 8 | 49.07 | 48.87 | 45.84 | 46.94 | 190.7 | 0.63 |
| 9 | 56.29 | 56.2 | 51.93 | 46.86 | 211.3 | 0.63 |
| 10 | 56.29 | 56.2 | 51.93 | 46.86 | 211.3 | 0.67 |
| 11 | 56.56 | 57.11 | 51.15 | 46.44 | 211.3 | 0.68 |
| 12 | 43.88 | 51.89 | 54.14 | 47.9 | 197.8 | 0.66 |
| 13 | 51.12 | 51.37 | 52.38 | 52.14 | 207 | 0.62 |
| 14 | 50.17 | 59.32 | 61.84 | 54.75 | 226.1 | 0.62 |
| 15 | 45.73 | 57.86 | 54.82 | 46.44 | 204.9 | 0.62 |
| 16 | 49.94 | 69.79 | 72.13 | 34.9 | 226.8 | 0.63 |
| 17 | 56.28 | 56.22 | 51.91 | 46.92 | 211.3 | 0.66 |

TABLE 1-continued

Test data used for training and validation of the neural network $NO_x$ emissions model

| | Gas Flow Rate (kscfh) | | | | | $NO_x$ |
|---|---|---|---|---|---|---|
| Test No. | Zone 1 | Zone 2 | Zone 3 | Zone 4 | Total | (lbm/MBtu) |
| 18 | 35.87 | 36.52 | 69.71 | 41.55 | 183.7 | 0.65 |
| 19 | 52.25 | 57.8 | 48.49 | 47.95 | 206.5 | 0.6 |
| 20 | 53.94 | 54.41 | 48.72 | 49.39 | 206.5 | 0.6 |

APPENDIX

For a multilayer feedforward neural network, the ordinary partial derivative of the output $x_n^{(l)}$ of the n'th unit in the l'th layer (n=1,2, . . . ,$J_l$ and I=2,3, . . . ,L) with respect to the l'th network input in the input layer $x^{(l)}$ (i=1,2, . . . ,$J_1$) is given by $$\frac{\partial x_n^{(l)}}{\partial x_i^{(1)}} = \sum_{q=1}^{J_{l-1}} \frac{\partial x_n^{(l)}}{\partial x_q^{(l-1)}} \frac{\partial x_q^{(l-1)}}{\partial x_i^{(1)}}, \tag{A}$$

where $J_{I-1}$ denotes the number of units in the (I−1)'th layer. Using the definitions of $x_n^{(l)}$ and $net_n^{(l)}$ in Eqs. (2) and (3) in the first partial derivative under the summation sign of the expression above, we obtain $$\frac{\partial x_n^{(l)}}{\partial x_i^{(1)}} = x_n^{(l)}(1 - x_n^{(l)}) \sum_{q=1}^{J_{l-1}} w_{nq}^{(l)} \frac{\partial x_q^{(l-1)}}{\partial x_i^{(1)}}. \tag{B}$$

This expression allows us to calculate, through recursive computations in the forward direction, i.e., from I=2 to I=L, the ordinary partial derivative of the network output with respect to the network input, and hence obtain $\partial NO_x/\partial g_j$. Once the activation levels of the network units $x_n^{(l)}$ have been computed through a standard forward pass, we compute $\partial x_n^{(L)}/\partial x_i^{(1)}$ by starting with I=2 in Eq. (B) and proceeding forward layer by layer until I=L=3 is reached, where the desired quantity $\partial x_n^{(L)}/\partial x_i^{(1)} = \partial NO_x/\partial g_j$ is calculated.

The embodiments of the invention in which an exclusive property or privilege is claimed are defined as follows:

1. For use in a fossil-fired boiler wherein steam is generated and emissions are produced, said fossil-fired boiler including a furnace having a primary combustion zone and an upper region above the primary combustion zone having a plurality of injectors for directing a substance into said upper region for reducing the emissions from said furnace, a method for determining a minimum cost to operate said injectors in the boiler, said method comprising the steps of:

modulating a plurality of flow rates of said injected substance above the primary combustion zone in the furnace over a range of flow rate values and measuring the level of emissions from said furnace at each of said flow rates values, wherein said injected substance includes natural gas, urea, ammonia, oil, a water-oil emulsion, or coal-water slurry and combinations thereof;

providing a model relating a distribution of the injected substance over said range of flow rate values to levels of emissions, wherein said model includes adjustable parameters determined for a specific boiler installation and is in the form of a multivariable nonlinear mathematical function;

determining for each flow rate value an optimal distribution of the injected substance that minimizes the level of emissions by applying an iterative optimization approach to said multivariable nonlinear mathematical function subject to constraints;

calculating an incremental substance cost per unit of emissions reduction for each optimum distribution; and determining a most cost-effective rate of substance injection by comparing the incremental substance injection costs with an open-market price of emission credits.

2. The method of claim 1 wherein each of said multivariable nonlinear mathematical function has a continuous first derivative.

3. The method of claim 2 wherein the step of determining a minimum level of emissions for the range of flow values includes calculating instantaneous partial derivatives of the emissions with respect to each of a plurality of substance injection points for said multivariable nonlinear mathematical function.

4. The method of claim 1 wherein the emissions include $NO_x$, CO and other pollutants.

5. The method of claim 1 wherein the step of modulating the flow rates of said injected substance includes varying an operating load of the boiler over a range of operating load values.

6. The method of claim 1 wherein said multivariable nonlinear mathematical function is represented in the form of an artificial neural network model.

7. The method of claim 6 further comprising the step of providing said artificial neural network in the form of a multi-layer feedforward neural network.

8. The method of claim 7 wherein the step of providing said artificial neural network further includes providing a three-layer feedforward neural network tuned with a conjugate gradient version of a backpropagation algorithm.

9. The method of claim 1 wherein the step of determining the minimum cost to reduce emissions through the substance injectors includes a decision-making advisory software system.

10. The method of claim 9 wherein the decision-making advisory software systems includes an expert system.

11. The method of claim 1 wherein the determination of the optimal distribution of the injected substance for a fixed total injection rate that minimizes the level of emissions includes iterative classical non-linear constrained optimization methods.

12. The method of claim 1 wherein the determination of the optimal distribution of the injected substance for a fixed total injection rate that minimizes the level of emissions includes non-classical artificial-intelligence-based non-linear constrained optimization methods.

13. The method of claim 12 wherein the non-classical artificial-intelligence-based non-linear constrained optimization methods are in the form of artificial neural networks.

14. The method of claim 1 wherein a fossil-fired boiler includes coal-fired boilers, oil-fired boilers, and gas-fired boilers.

* * * * *

UNITED STATES PATENT AND TRADEMARK OFFICE

CERTIFICATE OF CORRECTION

PATENT NO. : 6,507,774 B1 
DATED : January 15, 2003
INVENTOR(S) : Jacques Reifman et al.

It is certified that error appears in the above-identified patent and that said Letters Patent is hereby corrected as shown below:

Title page,
Item [73], Assignee, "Energy Sustems Associates", should be -- Energy Systems Associates --.

Signed and Sealed this

Twenty-first Day of October, 2003

JAMES E. ROGAN
*Director of the United States Patent and Trademark Office*